US009739523B1

(12) United States Patent
Augsburger

(10) Patent No.: US 9,739,523 B1
(45) Date of Patent: Aug. 22, 2017

(54) HINGE ASSEMBLY FOR A REFRIGERATOR APPLIANCE

(71) Applicant: Haier US Appliance Solutions, Inc., Wilmington, DE (US)

(72) Inventor: Joshua Keith Augsburger, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 15/218,133

(22) Filed: Jul. 25, 2016

(51) Int. Cl.

| | |
|---|---|
| ***E05F 1/02*** | (2006.01) |
| ***F25D 23/02*** | (2006.01) |
| ***E05F 1/04*** | (2006.01) |
| ***E05D 7/081*** | (2006.01) |
| ***E05D 5/14*** | (2006.01) |
| ***E05F 1/12*** | (2006.01) |
| ***E05D 3/02*** | (2006.01) |
| ***E05D 5/12*** | (2006.01) |
| ***F25D 11/00*** | (2006.01) |
| ***F25D 23/04*** | (2006.01) |
| ***F25D 25/02*** | (2006.01) |

(52) U.S. Cl.
CPC ..... *F25D 23/028* (2013.01); *E05D 3/02* (2013.01); *E05D 5/125* (2013.01); *E05D 5/14* (2013.01); *E05D 7/081* (2013.01); *E05F 1/043* (2013.01); *E05F 1/1207* (2013.01); *F25D 11/00* (2013.01); *F25D 23/04* (2013.01); *F25D 25/025* (2013.01); *E05Y 2900/31* (2013.01); *F25D 2323/024* (2013.01)

(58) Field of Classification Search
CPC ..... Y10T 16/539; F25D 23/028; F25D 23/04; F25D 2323/024; F25D 11/00; F25D 25/025; E05Y 2900/31; E05Y 2201/638; E05Y 2900/102; E05D 3/02; E05D 5/125; E05D 5/14; E05D 7/081; E05D 7/0027; E05F 1/043; E05F 1/1207; E05F 1/063
See application file for complete search history.

(56) References Cited

U.S. PATENT DOCUMENTS 2,302,484 A * 11/1942 Werner ..... E05D 7/0027 16/244
3,107,758 A * 10/1963 Benham ..... E05F 1/1223 16/284

(Continued)

FOREIGN PATENT DOCUMENTS

GB 2281099 A 2/1995
KR 100622259 B1 9/2006

(Continued)

*Primary Examiner* — Chuck Mah
(74) *Attorney, Agent, or Firm* — Dority & Manning, P.A.

(57) ABSTRACT

A hinge assembly for rotatably mounting an appliance door to a cabinet of an appliance includes a lower cam member coupled to a hinge support bracket and an upper cam member coupled to the appliance door. A pin assembly passes through the upper and lower cam members and is coupled to the hinge support bracket such that it defines an axis of rotation. The upper and lower cam members are configured to engage each other to urge the appliance door toward the closed position. The engagement may be a result of the weight of the door and the hinge assembly may further include a vertically oriented spring for assisting in the downward force of upper cam member.

19 Claims, 6 Drawing Sheets

(56) References Cited

U.S. PATENT DOCUMENTS 3,518,716 A * 7/1970 Larson ..... E05F 1/1223 16/284
4,030,161 A * 6/1977 Loikitz ..... E05F 1/063 16/284
4,215,449 A * 8/1980 Loikitz ..... E05F 1/063 16/303
4,864,691 A * 9/1989 Gidseg ..... E05D 3/04 16/312
5,138,743 A * 8/1992 Hoffman ..... E05F 1/1223 16/303
7,490,384 B2 * 2/2009 Lee ..... E05D 5/121 16/235
7,945,996 B2 * 5/2011 Gunderson ..... E05F 1/061 16/303
8,556,330 B2 * 10/2013 Lazarevich ..... E05D 7/1005 16/262
2006/0244351 A1 * 11/2006 Moon ..... F25D 23/028 312/405
2010/0218342 A1 * 9/2010 Bertolini ..... E05D 7/0027 16/244
2011/0302743 A1 12/2011 Kim et al.
2013/0067688 A1 * 3/2013 Kim ..... E05D 11/06 16/319
2013/0154464 A1 * 6/2013 Fiori ..... E05D 7/0423 312/405
2013/0249372 A1 * 9/2013 Lively ..... E05D 7/04 312/405
2013/0249373 A1 * 9/2013 Lively ..... E05D 7/0027 312/405
2013/0294371 A1 * 11/2013 Ishii ..... H04L 1/0003 370/329
2014/0215762 A1 * 8/2014 Mitchell ..... E05D 7/0423 16/374
2014/0259529 A1 * 9/2014 Jenkinson ..... E05D 7/0027 16/248
2014/0298615 A1 * 10/2014 Gouge ..... E05D 3/02 16/221
2015/0059126 A1 * 3/2015 Dubina ..... E05D 7/00 16/319
2015/0345203 A1 12/2015 Vanini
2016/0083993 A1 * 3/2016 Grewe ..... E05F 1/1223 16/291

FOREIGN PATENT DOCUMENTS

KR 20110035286 A * 4/2011
KR 20110043046 A * 4/2011
KR 101157804 B1 6/2012

* cited by examiner

HINGE ASSEMBLY FOR A REFRIGERATOR APPLIANCE

FIELD OF THE INVENTION

The present subject matter relates generally to appliances, such as refrigerator appliances, and hinge assemblies for the same.

BACKGROUND OF THE INVENTION

Certain refrigerator appliances utilize sealed systems for cooling chilled chambers of the refrigerator appliances. A typical sealed system includes an evaporator and a fan, the fan generating a flow of air across the evaporator and cooling the flow of air. The cooled air is then provided through an opening into the chilled chamber to maintain the chilled chamber at a desired temperature. Air from the chilled chamber is circulated back through a return duct to be re-cooled by the sealed system during operation of the refrigerator appliance, maintaining the chilled chamber at the desired temperature.

Refrigerator doors may provide access to the chilled chambers of refrigerator appliances. Such refrigerator doors commonly include an outer door frame, a door liner, and foam insulation. When in the closed position, refrigerator doors are intended to insulate the chilled chambers. However, refrigerator doors frequently fail to close completely and may fail to form a sufficient seal with a housing of the refrigerator appliance. In such situations, the temperature within the chilled chambers will rise, resulting in food spoilage and/or increased energy costs.

Accordingly, a refrigerator appliance including a hinge assembly having one or more features that ensure proper closing of the refrigerator doors would be useful. More particularly, a hinge assembly for a refrigerator door including spring-assisted cam closure mechanism that completely and reliably closes the refrigerator door would be especially beneficial.

BRIEF DESCRIPTION OF THE INVENTION

The present subject matter provides a hinge assembly for rotatably mounting an appliance door to a cabinet of an appliance. The hinge assembly includes a lower cam member coupled to a hinge support bracket and an upper cam member coupled to the appliance door. A pin assembly passes through the upper and lower cam members and is coupled to the hinge support bracket such that it defines an axis of rotation. The upper and lower cam members are configured to engage each other to urge the appliance door toward the closed position. The engagement may be a result of the weight of the door and the hinge assembly may further include a vertically oriented spring for assisting in the downward force of upper cam member. The resulting hinge assembly provides a simple and reliable mechanism for ensuring that the door of the appliance closes properly. Additional aspects and advantages of the invention will be set forth in part in the following description, or may be apparent from the description, or may be learned through practice of the invention.

In a first exemplary embodiment, a hinge assembly for rotatably mounting an appliance door to a cabinet of an appliance is provided. The hinge assembly includes a pin assembly defining an axis of rotation and a hinge support bracket attached to the cabinet, the hinge support bracket defining a hinge aperture configured for receiving the pin assembly. A lower cam member defines a lower cam aperture through which the pin assembly is received and a lower cam surface. An upper cam member is operably coupled to the appliance door and defines an upper cam aperture through which the pin assembly is rotatably received and an upper cam surface. The upper cam surface is configured to engage the lower cam surface to urge the appliance door toward a closed position.

According to another exemplary embodiment, a refrigerator appliance defining a vertical direction, a lateral direction, and a transverse direction is provided. The refrigerator appliance includes a cabinet defining a chilled chamber, a door being rotatably mounted to the cabinet to provide selective access to the chilled chamber, and a hinge assembly for rotatably mounting the door to the cabinet. The hinge assembly includes a hinge support bracket attached to the cabinet. A lower cam member is operably coupled to the hinge support bracket and defines a lower cam surface. An upper cam member is operably coupled to the door and defines an upper cam surface. A pin assembly defines an axis of rotation and rotatably couples the lower cam member and the upper cam member such that the upper cam surface is configured to engage the lower cam surface to urge the door toward a closed position.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
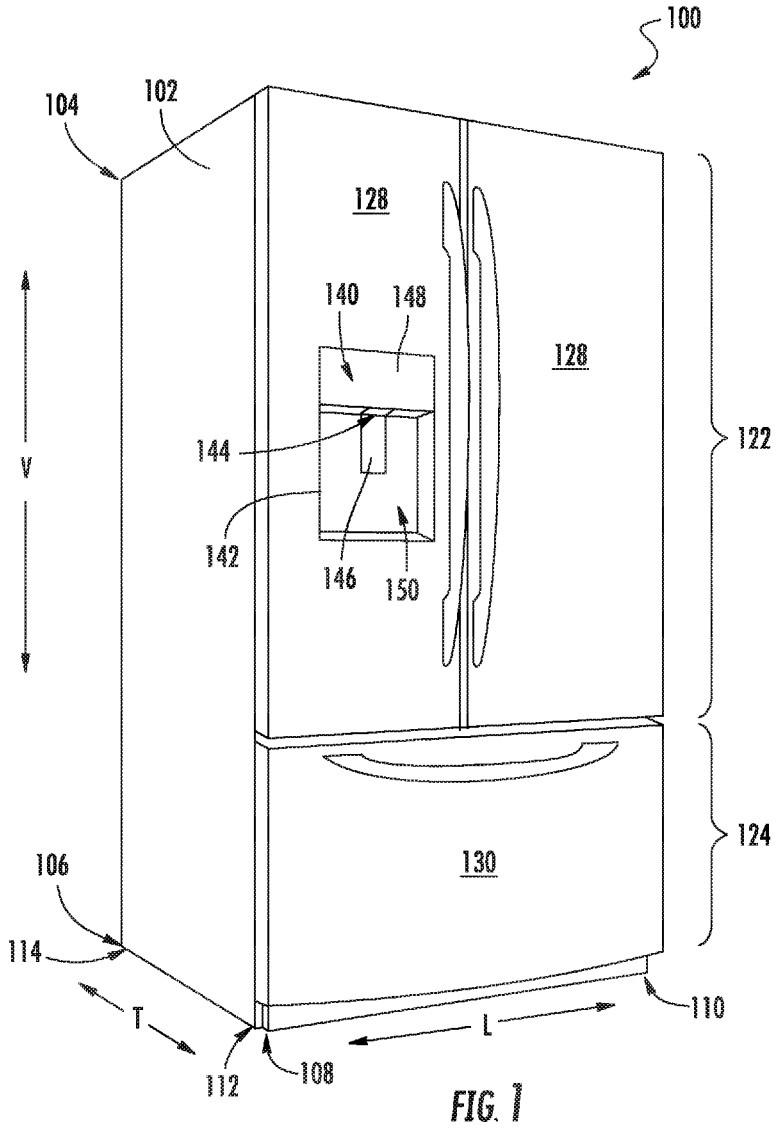
FIG. 1 provides a perspective view of a refrigerator appliance according to an exemplary embodiment of the present subject matter.

Reference now will be made in detail to embodiments of the invention, one or more examples of which are illustrated in the drawings. Each example is provided by way of explanation of the invention, not limitation of the invention.

In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a perspective view of a refrigerator appliance 100 according to an exemplary embodiment of the present subject matter. Refrigerator appliance 100 includes a cabinet or housing 102 that extends between a top 104 and a bottom 106 along a vertical direction V, between a first side 108 and a second side 110 along a lateral direction L, and between a front side 112 and a rear side 114 along a transverse direction T. Each of the vertical direction V, lateral direction L, and transverse direction T are mutually perpendicular to one another.

Housing 102 defines chilled chambers for receipt of food items for storage. In particular, housing 102 defines fresh food chamber 122 positioned at or adjacent top 104 of housing 102 and a freezer chamber 124 arranged at or adjacent bottom 106 of housing 102. As such, refrigerator appliance 100 is generally referred to as a bottom mount refrigerator. It is recognized, however, that the benefits of the present disclosure apply to other types and styles of refrigerator appliances such as, e.g., a top mount refrigerator appliance or a side-by-side style refrigerator appliance. Consequently, the description set forth herein is for illustrative purposes only and is not intended to be limiting in any aspect to any particular refrigerator chamber configuration.

As described in detail below, refrigerator doors 128 are rotatably hinged to an edge of housing 102 for selectively accessing fresh food chamber 122. In addition, a freezer door 130 is arranged below refrigerator doors 128 for selectively accessing freezer chamber 124. Freezer door 130 is coupled to a freezer drawer (not shown) slidably mounted within freezer chamber 124. Refrigerator doors 128 and freezer door 130 are shown in the closed configuration in FIG. 1.

Refrigerator appliance 100 also includes a dispensing assembly 140 for dispensing liquid water and/or ice. Dispensing assembly 140 includes a dispenser 142 positioned on or mounted to an exterior portion of refrigerator appliance 100, e.g., on one of refrigerator doors 128. Dispenser 142 includes a discharging outlet 144 for accessing ice and liquid water. An actuating mechanism 146, shown as a paddle, is mounted below discharging outlet 144 for operating dispenser 142. In alternative exemplary embodiments, any suitable actuating mechanism may be used to operate dispenser 142. For example, dispenser 142 can include a sensor (such as an ultrasonic sensor) or a button rather than the paddle. A control panel 148 is provided for controlling the mode of operation. For example, control panel 148 includes a plurality of user inputs (not labeled), such as a water dispensing button and an ice-dispensing button, for selecting a desired mode of operation such as crushed or non-crushed ice.

Discharging outlet 144 and actuating mechanism 146 are an external part of dispenser 142 and are mounted in a dispenser recess 150. Dispenser recess 150 is positioned at a predetermined elevation convenient for a user to access ice or water and enabling the user to access ice without the need to bend-over and without the need to open refrigerator doors 128. In the exemplary embodiment, dispenser recess 150 is positioned at a level that approximates the chest level of a user. As described in more detail below, the dispensing assembly 140 may receive ice from an icemaker disposed in a sub-compartment of the fresh food chamber 122.

Figure 2:
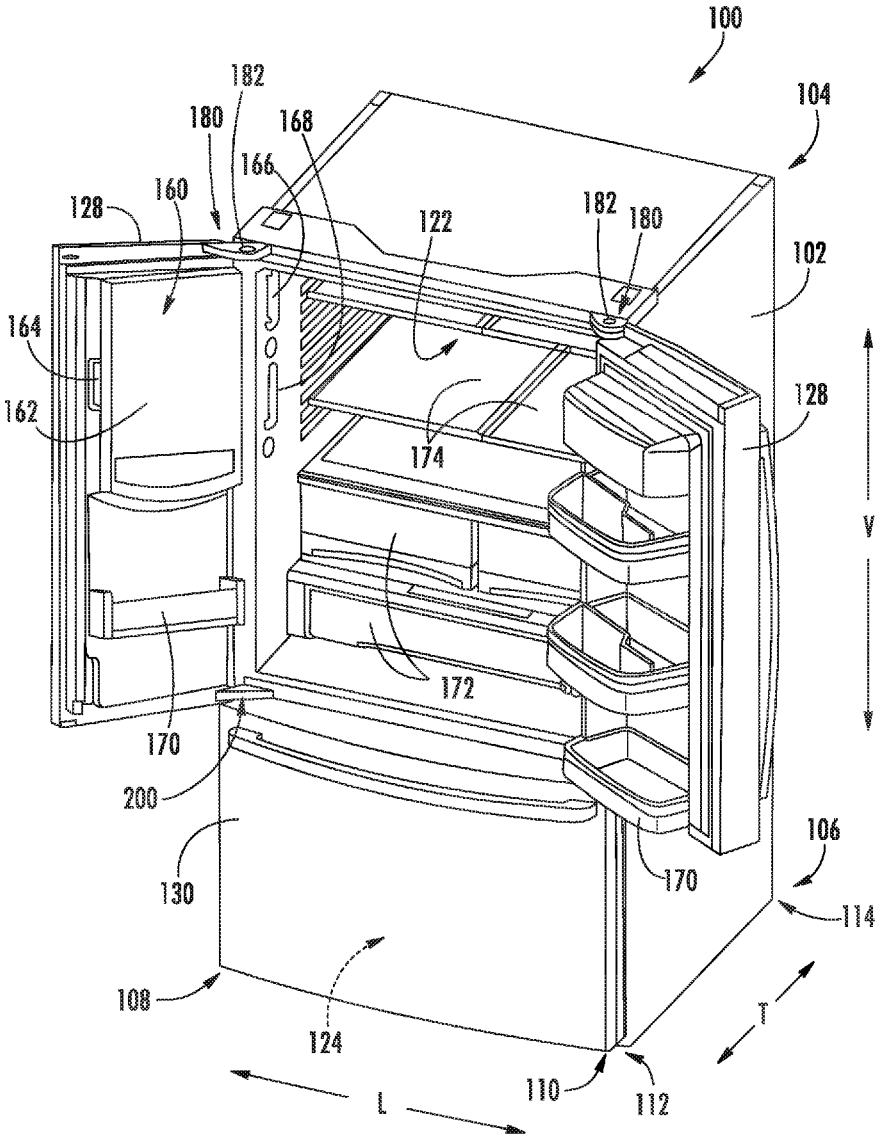
FIG. 2 provides a perspective view of the exemplary refrigerator appliance of FIG. 1 with refrigerator doors shown in an open position to reveal a fresh food chamber of the refrigerator appliance.
Figure 3:
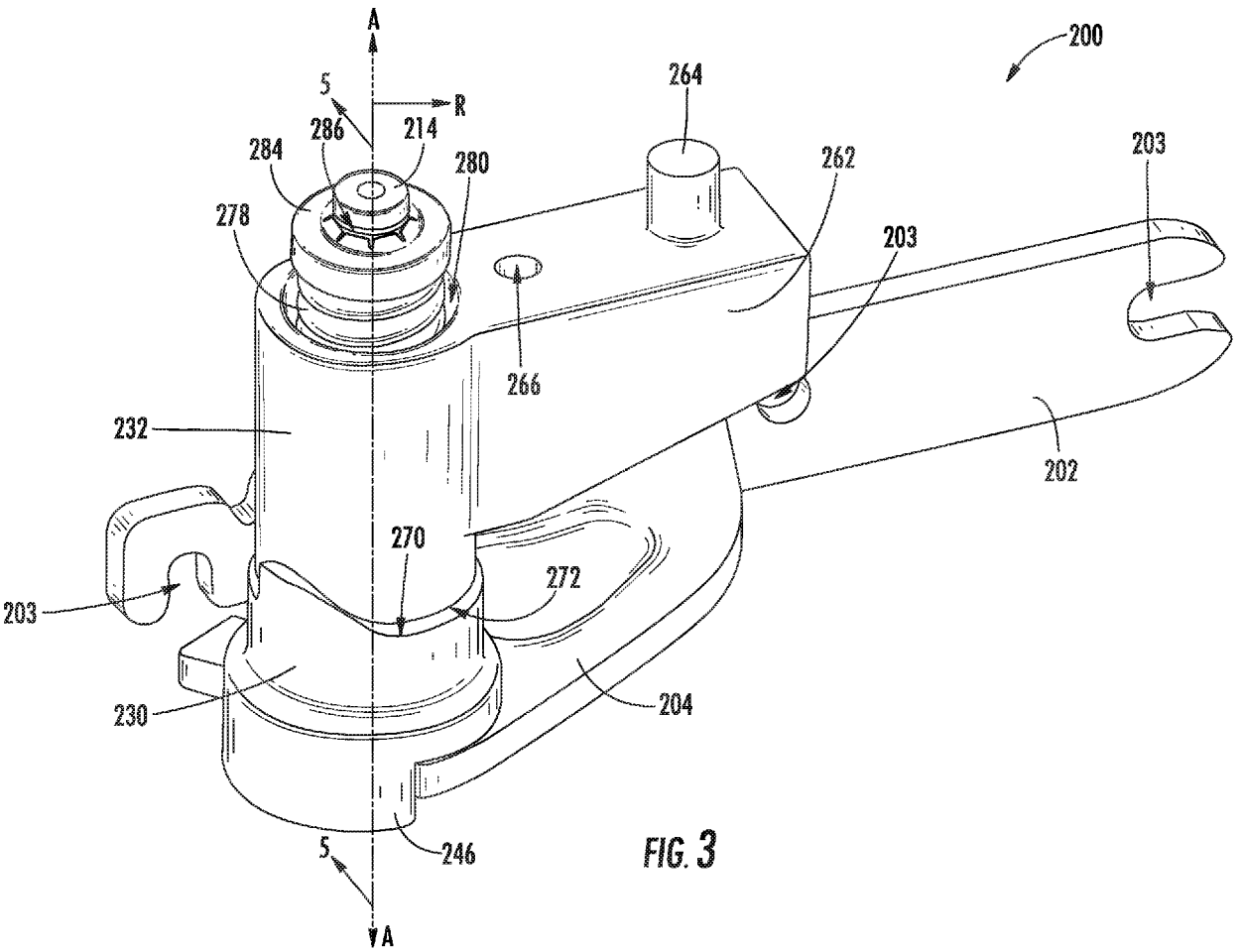
FIG. 3 provides a perspective view of a hinge assembly that may be used for mounting a refrigerator door of the exemplary refrigerator appliance of FIG. 1 according to an exemplary embodiment of the present subject matter.

FIG. 2 provides a perspective view of a door of refrigerator appliance 100 shown with refrigerator doors 128 in the open position. Refrigerator appliance 100 includes a sub-compartment, e.g., icebox compartment 160 defined on refrigerator door 128. Icebox compartment 160 extends into fresh food chamber 122 when refrigerator door 128 is in the closed position. An ice making assembly or icemaker (not shown) and an ice storage bin (not shown) may be positioned or disposed within icebox compartment 160. Thus, ice is supplied to dispenser recess 150 (FIG. 1) from the icemaker and the ice storage bin in icebox compartment 160 on a back side of refrigerator door 128.

An access door—e.g., icebox door 162—may be hinged to icebox compartment 160 in a manner described in detail below. Icebox door 162 permits selective access to icebox compartment 160. Any manner of suitable latch 164 is configured with icebox compartment 160 to maintain icebox door 162 in a closed position. As an example, latch 164 may be actuated by a consumer in order to open icebox door 162 for providing access into icebox compartment 160. Icebox door 162 can also assist with insulating icebox compartment 160, e.g., by thermally isolating or insulating icebox compartment 160 from fresh food chamber 122. This thermal insulation helps maintain icebox compartment 160 at a temperature below the freezing point of water. In addition icebox compartment 160 may receive cooling air from a chilled air supply duct 166 and a chilled air return duct 168 disposed on a side portion of housing 102 of refrigerator appliance 100. In this manner, the supply duct 166 and return duct 168 may recirculate chilled air from a sealed cooling system (not shown) through icebox compartment 160.

According to the illustrated embodiment, various storage components are mounted within fresh food chamber 122 to facilitate storage of food items therein as will be understood by those skilled in the art. In particular, the storage components include bins 170, drawers 172, and shelves 174 that are mounted within fresh food chamber 122. Bins 170, drawers 172, and shelves 174 are configured for receipt of food items (e.g., beverages and/or solid food items) and may assist with organizing such food items. As an example, drawers 172 can receive fresh food items (e.g., vegetables, fruits, and/or cheeses) and increase the useful life of such fresh food items.

As explained above, refrigerator door 128 is an outer door movable between a closed position (FIG. 1) closing fresh food chamber 122 and an opened position allowing access to the interior of fresh food chamber 122 (FIG. 2). To achieve such movement, refrigerator door 128 may be supported by an upper hinge assembly 180 and a lower hinge assembly 200.

According to the illustrated exemplary embodiment, upper hinge assembly 180 may include an upper hinge bracket 182 extending from housing 102 in a direction substantially parallel to transverse direction T. In addition, upper hinge assembly may include an upper hinge pin (not shown) extending from upper hinge bracket 182 toward refrigerator door 128 along the vertical direction V. Refrigerator door 128 may define an upper recess (not shown) configured for rotatably receiving the upper hinge pin. More specifically, according to an exemplary embodiment, the upper recess is a cylindrically shaped recess and the upper hinge pin is a cylindrically-shaped rod configured to be rotatably received within the upper recess. In this manner, together with lower hinge assembly 200 (described below), upper hinge assembly 180 rotatably supports refrigerator door 128 to permit selective access to fresh food chamber 122. It should be appreciated that upper hinge assembly 180 described above is only exemplary and that other suitable hinge mechanisms for rotatably supporting refrigerator door 128 are possible and within the scope of the present subject matter.

Referring now generally to FIGS. 3 through 8, a lower hinge assembly 200 that may be used for mounting refrigerator door 128 according to an exemplary embodiment of the present subject matter will be described in more detail. As described below, after refrigerator door 128 is properly mounted to upper hinge assembly 180 and lower hinge assembly 200, refrigerator door 128 may rotate freely about an axis of rotation A defined by hinge assemblies 180, 200. A radial direction R is defined perpendicularly to the axis of rotation A.

According to the illustrated exemplary embodiment, lower hinge assembly 200 includes a hinge support bracket 202. Hinge support bracket 202 is attached to and extends from a front surface of housing 102 in a direction substantially parallel to transverse direction T. In this regard, hinge support bracket 202 defines holes 203 that are configured to receive a mechanical fastener, e.g., a screw, bolt, or rivet, to secure hinge support bracket 202 to housing 102. Hinge support bracket 202 defines a support surface 204 extending substantially within the horizontal plane defined by the lateral direction L and the transverse direction T. Hinge support bracket 202 may further define a hinge aperture 206 extending along the vertical direction V through the support surface 204. More specifically, for reasons described below, hinge aperture 206 may be a cylindrically-shaped aperture having a threaded surface 208 on its internal circumference.

Lower hinge assembly 200 may further include a pin assembly 210. According to the illustrated exemplary embodiment, pin assembly 210 includes a pin base 212 and a hinge pin 214. Pin base 212 may be configured for receipt in hinge aperture 206, such that hinge pin 214 extends substantially along the vertical direction V and defines the axis of rotation A of refrigerator door 128. As used herein, "substantially" means within five degrees of the stated direction, e.g., within five degrees of the vertical direction V.

According to the illustrated embodiment, pin base 212 defines a threaded boss 216. Threaded boss 216 is screwed into and engages threaded surface 208 of hinge aperture 206 to couple pin assembly 210 to hinge support bracket 202. Moreover, as will be described below, rotating pin base 212 relative to hinge support bracket 202 causes pin assembly 210 (and thus refrigerator door 128) to move along the vertical direction V. More specifically, if pin base 212 is rotated clockwise, pin assembly 210 and refrigerator door 128 move upward along the vertical direction V. By contrast, if pin base 212 is rotated counterclockwise, pin assembly 210 and refrigerator door 128 move downward along the vertical direction V. In this manner, the position of refrigerator door 128 may be easily adjusted by a consumer.

Figure 5:
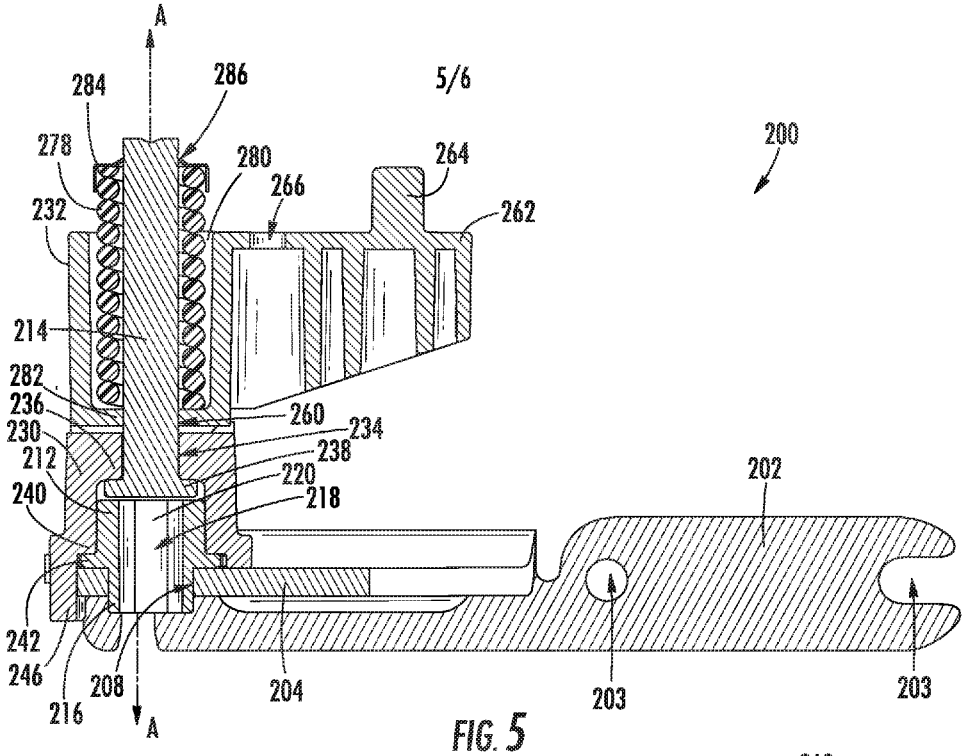
FIG. 5 provides a cross sectional view of the exemplary hinge assembly of FIG. 3, taken along Line 5-5 of FIG. 3.

According to the illustrated embodiment, pin base 212 and hinge pin 214 are in contact with each other such that hinge pin 214 is supported by pin base 212, but the two components are not fixedly attached. According to an alternative embodiment, as illustrated in FIG. 5, pin base 212 may define an internal channel 218 with an inner threaded surface 220. Inner threaded surface 220 may be configured to engage a set screw (not shown) such that rotating the set screw within channel 218 causes the set screw to move upward along the vertical direction V. If desired, a user may rotate the set screw such that it protrudes out of channel 218 on top of pin base 212, thereby causing separation between pin base 212 and hinge pin 214. This may allow for further raising and adjusting refrigerator door 128. However, it should be appreciated that pin assembly 210 may be a single, fixed part according to alternative embodiments.

According to the illustrated exemplary embodiment, lower hinge assembly 200 may further include a lower cam member 230 and an upper cam member 232. As will be described below, cam members 230, 232 are generally configured to engage each other to urge refrigerator door 128 toward the closed position.

Lower cam member 230 is generally coupled to hinge support bracket 202 and pin assembly 210. More specifically, lower cam member 230 is a generally cylindrical member oriented along the vertical direction V. A lower cam aperture 234 passes through the center of lower cam member 230 and is configured to receive hinge pin 214. Thus, lower cam member 230 may slide onto hinge pin 214 such that it is rotatably supported by pin assembly 210 and vertically supported by hinge support bracket 202. More specifically, as best illustrated in FIG. 5, lower cam member 230 may define a first shoulder 236 that is vertically supported by a hinge pin flange 238 and a second shoulder 240 that is vertically supported by a pin base flange 242.

According to an exemplary embodiment, lower cam member 130 is configured such that it does not rotate about the axis of rotation A relative to hinge support bracket 202 but may move along the vertical direction V. More specifically, support surface 204 of hinge support bracket 202 may define an arcuate recess 244 around its circumference. In addition, lower cam member 230 may define an axially protruding lip 246 which is configured to engage the arcuate recess 244 to prevent rotation of lower cam member 230 relative to hinge support bracket 202. Notably, axially protruding lip 246 extends far enough along the vertical direction V such that axially protruding lip 246 engages arcuate recess 244 to prevent rotation even if pin assembly 210 has been adjusted to raise refrigerator door 128, as described above. Moreover, it should be appreciated that other configurations for restricting the rotation of lower cam member 230 while allowing for its movement along the vertical direction V are possible and within the scope of the present subject matter.

Upper cam member 232 is operably coupled to refrigerator door 128 and pin assembly 210. More specifically, upper cam member 232 is a generally cylindrical member oriented along the vertical direction V. An upper cam aperture 260 passes through the center of upper cam member 232 and is configured to receive hinge pin 214. Thus, upper cam member 232 may slide onto hinge pin 214 such that it is rotatably supported by pin assembly 210 and vertically supported by lower cam member 230.

Figure 4:
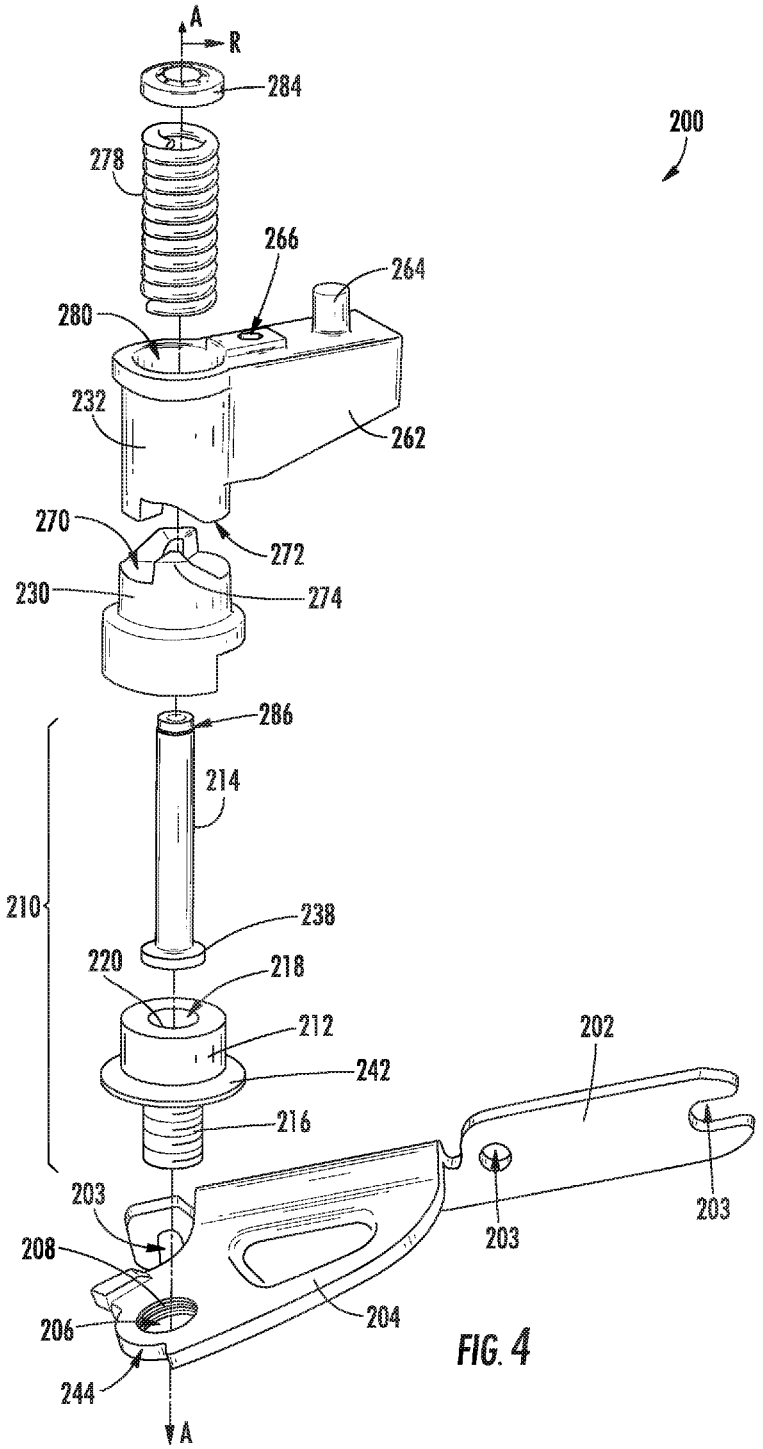
FIG. 4 provides an exploded perspective view of the exemplary hinge assembly of FIG. 3.

As illustrated in FIG. 4, upper cam member 232 has features to ensure it is securely coupled with refrigerator door 128. In this regard, upper cam member 232 is configured for receipt in a recess (not shown) defined on the bottom of refrigerator door 128. Moreover, upper cam member 232 defines a door locating arm 262 that extends perpendicularly from the axis of rotation A, i.e., along the radial direction R. Door locating arm 262 has a profile that complements the recess of refrigerator door 128. Moreover, door locating arm 262 may further define a door locating pin 264 that extends vertically from a distal end of door locating arm 262 and is configured to engage a complementary recess on refrigerator door 128. In addition, upper cam member 232 may define an aperture 266 that is configured to receive a mechanical fastener, e.g., a screw, bolt, or rivet, to secure upper cam member 232 to refrigerator door 128. In this manner, upper cam member 232 is both rotationally and vertically fixed relative to refrigerator door 128.

Figure 6:
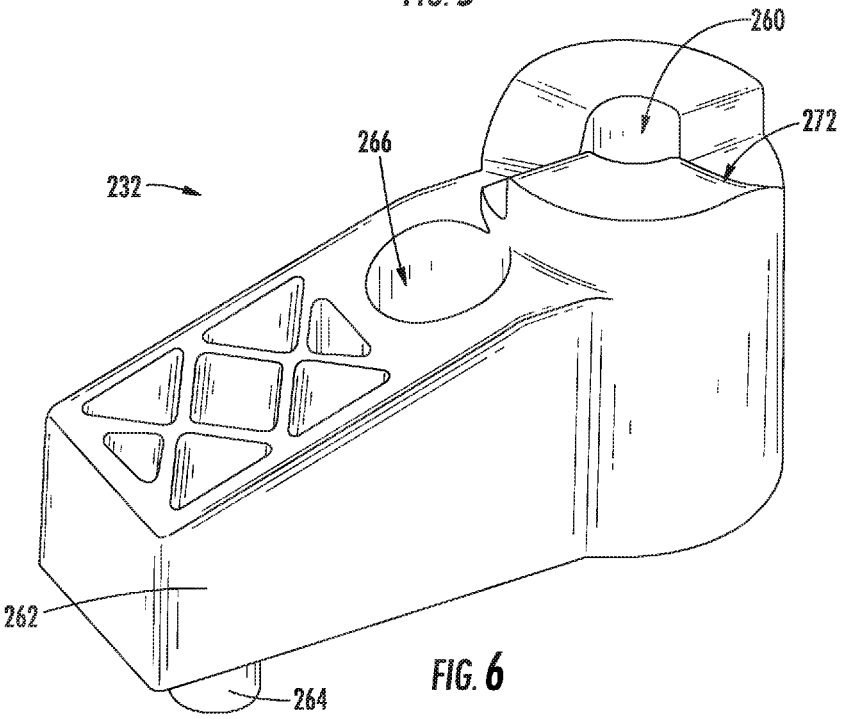
FIG. 6 provides a bottom perspective view of an upper cam member of the exemplary hinge assembly of FIG. 3.
Figure 7:
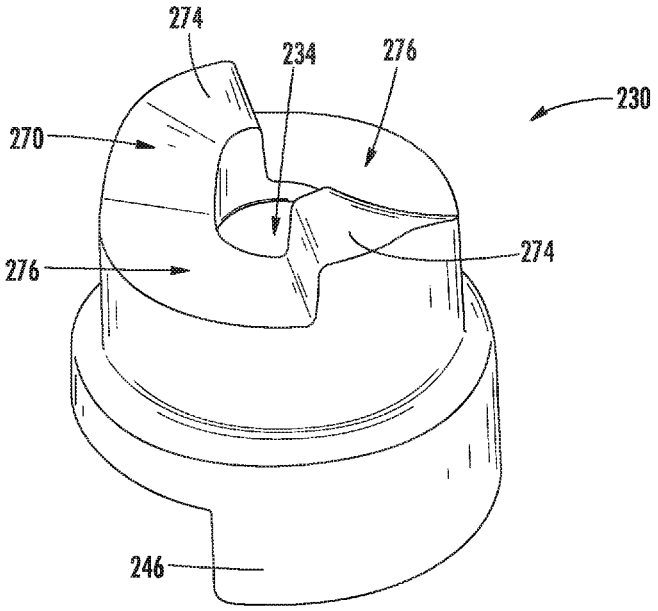
FIG. 7 provides a top perspective view of a lower cam member of the exemplary hinge assembly of FIG. 3.
Figure 8:
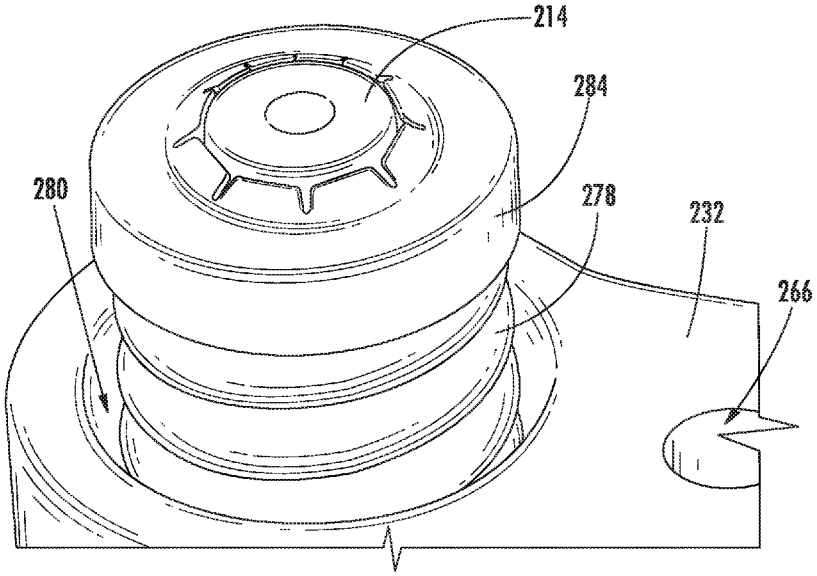
FIG. 8 provides a perspective view of a pin assembly and a spring retainer clip of the exemplary hinge assembly of FIG. 3.

As best illustrated in FIGS. 4, 6, and 7, cam members 230, 232 define cam surfaces that are configured to engage each other and impart a rotational force about the axis of rotation A. Because lower cam member 230 is fixed relative to hinge support bracket 202 and upper cam member 232 is fixed relative to refrigerator door 128, the rotational force causes refrigerator door 128 to rotate relative to housing 102 such that refrigerator door 128 is always urged toward the closed position. More specifically, lower cam member 230 may further define a lower cam surface 270 that extends upward along the vertical direction V. In addition, upper cam member 232 may further define an upper cam surface 272 that extends downward along the vertical direction V. Upper cam surface 272 is configured to engage lower cam surface 270 to urge refrigerator door 128 toward the closed position.

For example, as best illustrated in FIG. 7, lower cam surface 270 of lower cam member 230 is generally defined by two cam teeth 274. Cam teeth 274 extend along the vertical direction V toward upper cam member 232. Cam teeth 274 are positioned around lower cam aperture 234 and are spaced apart around the circumference of lower cam member 232 by approximately 180 degrees. Each tooth 274 has a sharp rise, a plateau, and then a sloping portion when lower cam surface 270 is followed along the counterclockwise direction as oriented in FIG. 7. Lower cam surface 270 also defines grooves 276 at the bottom of each cam tooth 274 which are the low point in the lower cam surface 270. It should be appreciated that upper cam surface 272 of upper cam member 232 may have a complementary profile to lower cam surface 270 of lower cam member 230 to ensure upper cam surface 272 and lower cam surface 270 interact as described herein. Other embodiments for cam member 230 may be used as well.

According to the illustrated exemplary embodiment, lower hinge assembly 200 may further include a mechanical spring 278 to provide additional vertical force (and thus rotational force) between cam surfaces 270, 272. More specifically, as best illustrated in FIG. 5, upper cam member 232 may define a channel 280 that is configured to receive spring 278. Spring 278 slides around hinge pin 214 and is vertically supported on the bottom by a shoulder 282 that protrudes inwardly along the radial direction R from channel 280. Moreover, a spring retaining clip 284 may be positioned at a distal end of hinge pin 214 to prevent spring 278 from being removed from hinge pin 214 and to ensure spring 278 remains compressed at all times. According to the illustrated embodiment, spring retaining clip 284 is snapped into a circumferential groove 286 defined on the end of hinge pin 214. So configured, spring 278 is oriented such that it exerts a force along the axis of rotation A. Although a spring retaining clip 284 is described above as being used to retain spring 278, it should be appreciated that any other suitable mechanism may be used for retaining spring 278 within channel 280, such as a nut and bolt or another suitable mechanical fastener.

Notably, once spring 278 is installed into upper cam member 232 around hinge pin 214 and retained in place by spring retaining clip 284, spring 278 provides a downward force along the vertical direction V to assist the weight of refrigerator door 128 in engaging cam surfaces 270, 272. Notably, the length and stiffness of spring 278 may be adjusted depending on the application, but according to the illustrated embodiment, spring 278 is always in compression, even when refrigerator door 128 is in the closed position. In this manner, spring 278 is constantly urging refrigerator door 128 into the closed position and ensures a tight seal between refrigerator door 128 and housing 102.

According to the illustrated exemplary embodiment, lower cam surface 270 and upper cam surface 272 both have a parabolic profile that is oriented such that the weight of refrigerator door 128 generates a rotational closing force due to the interaction between lower cam surface 270 and upper cam surface 272. Moreover, the parabolic profile is designed such that the rotational force generated by cam surfaces 270, 272 increases as refrigerator door 128 approaches the closed position. This may be preferable to compensate for a decreasing force exerted by spring 278 as the door approaches the closed position. In this regard, the increasing torque exerted by cam surfaces 270, 272 is used to compensate for the decreasing spring 278 force to ensure that the torque exerted on refrigerator door 128 is substantially constant between the open and the closed positions.

In addition, lower cam surface 270 and upper cam surface 272 are configured such that they are still engaged (i.e., the cams have not "bottomed out" such that cam teeth 274 are not fully received into grooves 276) when refrigerator door 128 is in the closed position. In this manner, the rotational closing force is maintained even when refrigerator door 128 is in the closed position, thereby ensuring that refrigerator door 128 is always closed with sufficient force to create an airtight seal. Cam surfaces 270, 272 may be designed as needed to obtain the desired amount of closing force when refrigerator door 128 is in the closed position.

As one skilled in the art will appreciate, the above described embodiment is used only for the purpose of explanation. Modifications and variations may be applied, other configurations may be used, and the resulting configurations may remain within the scope of the invention. For example, although lower hinge assembly 200 is described above as rotatably supporting refrigerator door 128, it should be appreciated that lower hinge assembly 200 may be used to support doors of other appliances, or any other door having a vertical axis of rotation. Moreover, the specific configuration of lower hinge assembly 200 described herein is only exemplary. Modifications and variations to the construction and configuration of lower hinge assembly 200 may be applied, and such modifications may remain within the scope of the present subject matter.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A hinge assembly rotatably mounting an appliance door to a cabinet of an appliance, the hinge assembly comprising:

a pin assembly defining an axis of rotation, the pin assembly comprising a pin base defining a threaded boss and a hinge pin having a flange supported by the pin base, the hinge pin extending from the pin base;

a hinge support bracket attached to the cabinet, the hinge support bracket defining a hinge aperture, the hinge aperture defining a threaded surface configured for receiving and engaging the threaded boss of the pin base such that rotating the pin base in one direction moves the pin assembly along the axis of rotation;

a lower cam member defining a lower cam aperture through which the pin assembly is received, the lower cam member defining a lower cam surface; and an upper cam member operably coupled to the appliance door, the upper cam member defining an upper cam aperture through which the pin assembly is rotatably received and an upper cam surface, the upper cam surface being configured to engage the lower cam surface to urge the appliance door toward a closed position.

2. The hinge assembly of claim 1, wherein the upper cam member defines a door locating arm and the appliance door defines a recess configured for receiving the upper cam member and the door locating arm to fix the appliance door relative to the upper cam member.

3. The hinge assembly of claim 1, further comprising a spring, wherein the upper cam member defines a channel configured for receiving the spring for urging the upper cam member down onto the lower cam member.

4. The hinge assembly of claim 3, wherein the channel and the spring are oriented along the axis of rotation.

5. The hinge assembly of claim 3, wherein the pin assembly defines a circumferential groove, the hinge assembly further comprising a spring retainer clip snapped into the groove to secure the spring within the channel of the upper cam member.

6. The hinge assembly of claim 1, wherein the upper cam surface and the lower cam surface both have a parabolic profile such that a rotational closing force generated by the interaction between the upper cam surface and the lower cam surface increases as the appliance door approaches the closed position.

7. The hinge assembly of claim 1, wherein the upper cam surface and the lower cam surface are still engaged when the appliance door is in the closed position, such that the upper cam surface and the lower cam surface are still applying a rotational closing force to the appliance door when the appliance door is in the closed position.

8. The hinge assembly of claim 1, wherein the lower cam member defines an axially extending lip and the hinge support bracket defines a recess, the recess being configured to receive the axially extending lip to prevent rotation of the lower cam member.

9. The hinge assembly of claim 1, wherein the axis of rotation defined by the pin assembly is substantially parallel to a vertical direction defined by the appliance.

10. The hinge assembly of claim 1, wherein the appliance is a refrigerator appliance and the appliance door is a refrigerator door.

11. The hinge assembly of claim 1, wherein the pin base defines an internal channel with an inner threaded surface, the hinge assembly further comprising:

a set screw positioned within the internal channel and engaging the inner threaded surface such that rotating the set screw in one direction within the internal channel causes the set screw to separate the pin base and the hinge pin relative to each other.

12. A refrigerator appliance defining a vertical direction, a lateral direction, and a transverse direction, the refrigerator appliance comprising:

a cabinet defining a chilled chamber;

a door being rotatably mounted to the cabinet to provide selective access to the chill chamber; and a hinge assembly rotatably mounting the door to the cabinet, the hinge assembly comprising:

a hinge support bracket attached to the cabinet;

a lower cam member operably coupled to the hinge support bracket and defining a lower cam surface;

an upper cam member operably coupled to the door and defining an upper cam surface; and a pin assembly defining an axis of rotation, the pin assembly comprising a pin base defining a threaded boss and a hinge pin having a flange supported by the pin base, the pin assembly rotatably coupling the lower cam member and the upper cam member such that the upper cam surface is configured to engage the lower cam surface to urge the door toward a closed position.

13. The refrigerator appliance of claim 12, wherein the upper cam member defines a door locating arm and the door defines a recess configured for receiving the upper cam member and the door locating arm to fix the door relative to the upper cam member.

14. The refrigerator appliance of claim 12, wherein the upper cam member defines a channel configured for receiving a spring for urging the upper cam member down onto the lower cam member, wherein the channel and the spring are oriented along the axis of rotation.

15. The refrigerator appliance of claim 14, wherein the pin assembly defines a circumferential groove, the hinge assembly further comprising a spring retainer clip snapped into the groove to secure the spring within the channel of the upper cam member.

16. The refrigerator appliance of claim 12, wherein the upper cam surface and the lower cam surface are still engaged when the door is in the closed position, such that the upper cam surface and the lower cam surface are still applying a rotational closing force to the door when the door is in the closed position.

17. The refrigerator appliance of claim 12, wherein the lower cam member defines an axially extending lip and the hinge support bracket defines a recess, the recess being configured to receive the axially extending lip to prevent rotation of the lower cam member.

18. The refrigerator appliance of claim 12, wherein the axis of rotation defined by the pin assembly is substantially parallel to the vertical direction.

19. The refrigerator appliance of claim 12, wherein the pin base defines an internal channel with an inner threaded surface, the hinge assembly further comprising:

a set screw positioned within the internal channel and engaging the inner threaded surface such that rotating the set screw in one direction within the internal channel causes the set screw to separate the pin base and the hinge pin relative to each other.

* * * * *